US007393085B2

(12) United States Patent
Lecheheb et al.

(10) Patent No.: US 7,393,085 B2
(45) Date of Patent: Jul. 1, 2008

(54) METHOD OF OPERATING A CONTINUOUS INK JET PRINTER APPARATUS

(75) Inventors: Ammar Lecheheb, Cambridge (GB); David Andrew Horsnell, Cambridge (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 10/571,025

(22) PCT Filed: Sep. 2, 2004

(86) PCT No.: PCT/EP2004/009778

§ 371 (c)(1),
(2), (4) Date: Dec. 7, 2006

(87) PCT Pub. No.: WO2005/023549

PCT Pub. Date: Mar. 17, 2005

(65) Prior Publication Data

US 2007/0115312 A1 May 24, 2007

(30) Foreign Application Priority Data

Sep. 5, 2003 (GB) ..... 0320773.5

(51) Int. Cl.
*B41J 2/085* (2006.01)
*B41J 2/09* (2006.01)

(52) U.S. Cl. ..... 347/76; 347/77

(58) Field of Classification Search ..... 347/73–74, 347/75, 76–79, 80, 90, 10, 28
See application file for complete search history.

(56) References Cited

U.S. PATENT DOCUMENTS 4,897,667 A * 1/1990 Uchiyama et al. ..... 347/10
6,309,058 B1 * 10/2001 Lecheheb et al. ..... 347/73

* cited by examiner

*Primary Examiner*—K. Feggins
(74) *Attorney, Agent, or Firm*—McAndrews, Held & Malloy, Ltd.

(57) ABSTRACT

A method of operating a continuous ink jet printer apparatus, the method comprising the steps of: applying a first voltage pulse to an electrode in order to modify the direction of an ink stream; applying a second voltage pulse to the electrode for a pre-determined period of time; measuring the charge carried on the ink stream; and modifying the operation of the printer in response to the charge measured.

9 Claims, 5 Drawing Sheets

METHOD OF OPERATING A CONTINUOUS INK JET PRINTER APPARATUS

The present invention relates to a method of operating a continuous ink jet printer apparatus.

The technique of continuous ink jet printing requires a continuous stream of ink which is broken up into droplets which are then selectively charged. For a binary array continuous ink jet printer, the non-charged droplets are allowed to pass to the substrate for printing, while charged droplets are deflected by an electrical field into a gutter, and are thus not printed on the substrate, where they can be collected for re-use. An advantage of this technique is that the alignment of the droplets on the substrate is not dependent on the ability to accurately and uniformly charge the droplets. Small variations in the charge applied will not affect the quality of the printing, as long as the charge is sufficient to cause the droplets to be deflected away from the substrate and into the gutter. Furthermore, this ability to vary the charge applied to the droplets in order to direct them into the gutter may be exploited in order to measure the continuous phasing.

The droplet generator creates a stream of droplets of ink by applying an electrical waveform to an electrode. This continuous ink stream leaves the print head and breaks up into individual droplets at the "break-up point" which is usually referred to either as the break-up distance or time from the print head. In order to impart a charge to a droplet, the charging waveform must straddle the break-up point, the charge must be applied to the stream at the moment before the droplet separates from the stream and be held until the droplet is free from the stream. It is therefore necessary to know at exactly what phase of the modulating waveform the break-up occurs and this measurement is typically referred to as phasing or phase setting.

For a binary array printer comprising 256 ink jets, the manufacturing tolerances of the nozzles and the characteristics of each ink cavity result in a different break-up point for each stream, and hence a different phase setting is required for each ink stream. As the break-up point depends on a number of parameters such as ink viscosity, temperature and velocity, over long periods of printing these parameters will vary and thus it is necessary to continuously re-adjust the print head in order to maintain the print quality. It is not sufficient to set the phasing when the printer is turned on, even allowing a time for the printer to settle, and then rely on an initial calibration for a prolonged period of printing. Thus it is a requirement for continuous phasing or continuously measuring the phase relationship for each droplet stream, so adjustments can be made during the printing process, although not actually while printing.

The phase setting is measured using a charge detector positioned after the charging electrode, which is able to detect which droplets have been successfully charged. A half width charging pulse, which is progressively advanced by predetermined time intervals relative to the modulation waveform, is used to charge the droplets. Since only half of the half width pulses will straddle the break-up point, half the pulses will fail and half will succeed in charging the droplets. By progressively advancing the half width pulses and detecting the results, the break-up point can be determined and the full width printing pulses can be positioned to straddle the break-up point accurately. The time interval used is the equivalent of one-sixteenth of the modulation wavelength, so after 16 half width pulses, the whole modulation waveform has been covered. This interval is considered to provide a reasonable compromise between adequate accuracy/resolution without taking too long to perform.

One of the problems associated with phase measurement, both at start-up and during printing, relates to the large number of very closely spaced ink streams. As it is difficult to duplicate the charge electrode driver circuitry 256 times, typically 64 channel integrated drivers will be used to save space and power. However, whilst these driver devices do not allow enabling or setting the charge voltage of individual streams, they do allow individual streams to be driven with a continuous charge voltage. It is also not possible to have individual phase detectors for each ink stream because it is difficult to measure accurately the charge of one ink stream without the measurement influenced by the charge applied to adjacent streams.

Phase setting during the printing process uses the relatively electrically quiet period between print cycles. During this period the charge electrode driver outputs are not being switched and are held at the normal charge deflection voltage. One of the problems is that it in order to test individual ink droplets it is necessary to detect the non-charged state. However, this has the undesirable effect of depositing ink on to the substrate as it is not possible to move the gutter, or some other barrier, cannot be moved in and out of the "catch-all" position in the short period between print cycles. Furthermore, when a single ink stream is turned off against a background of all the other ink streams remaining on, the phase detector circuits may find it difficult to detect the change in charge for that ink stream. The use of the half-width pulses is not possible since all non-printed droplets must be charged in order to be deflected into the gutter and the half width pulses have segments in which there is no charge applied to the droplets.

According to a first aspect of the invention there is provided a method of operating a continuous ink jet printer apparatus, the method comprising the steps of: applying a first voltage pulse to an electrode in order to modify the direction of an ink stream; applying a second voltage pulse to the electrode for a pre-determined period of time; measuring the charge carried on the ink stream; and modifying the operation of the printer in response to the charge measured.

The timing and/or magnitude of the first voltage pulse may be modified in response to the charge measured.

The second voltage pulse may have a positive or a negative sense.

The method of the present invention provides the following advantages when compared with known techniques for continuous ink jet printing: the method enables separate continuous charging inputs to be used, allowing varied groups of ink jets to be selected for continuous phasing, for example groups of 8, 4, 2 or even a single ink jet. Existing techniques are limited to phasing with a predetermined group of ink jets and therefore the resolution and accuracy is low. The use of the second voltage pulse allows the continuous phasing group size to be selected in order to suit the available signal-to-noise ratio, allowing a much more accurate phase synchronisation. By selecting individual ink jets fewer components are required to perform the continuous phase measurement. For greater accuracy the number of jets in a group should be as small as possible. In known apparatus, each group is controlled from one controller, so the bigger the array the higher the number of integrated circuits would be required. The present invention requires fewer extra circuits that control the whole the continuous phasing to the whole array.

According to a second aspect of the invention there is provided a continuous ink jet printer apparatus including circuitry for applying a first voltage pulse to an electrode in order to modify the direction of an ink stream, and for applying simultaneously a second voltage pulse to the electrode for a pre-determined period of time for detecting the phase of the ink jet stream.

According to a third aspect of the invention there is provided a printer apparatus comprising an electrode, first and second voltage sources and a resistor network, the electrode being electrically connected to the voltage sources via the resistor network. In use, the printer apparatus may be operated in a first state by applying a low signal from the first and second voltage sources to the electrode; in a second state by applying a low signal from the first voltage source and a high signal from the second voltage source to the electrode; and in a third state by applying a high signal from the first and second voltage sources to the electrode.

The invention will now be described, by way of example only, with reference to the following Figures in which.

Figure 1:
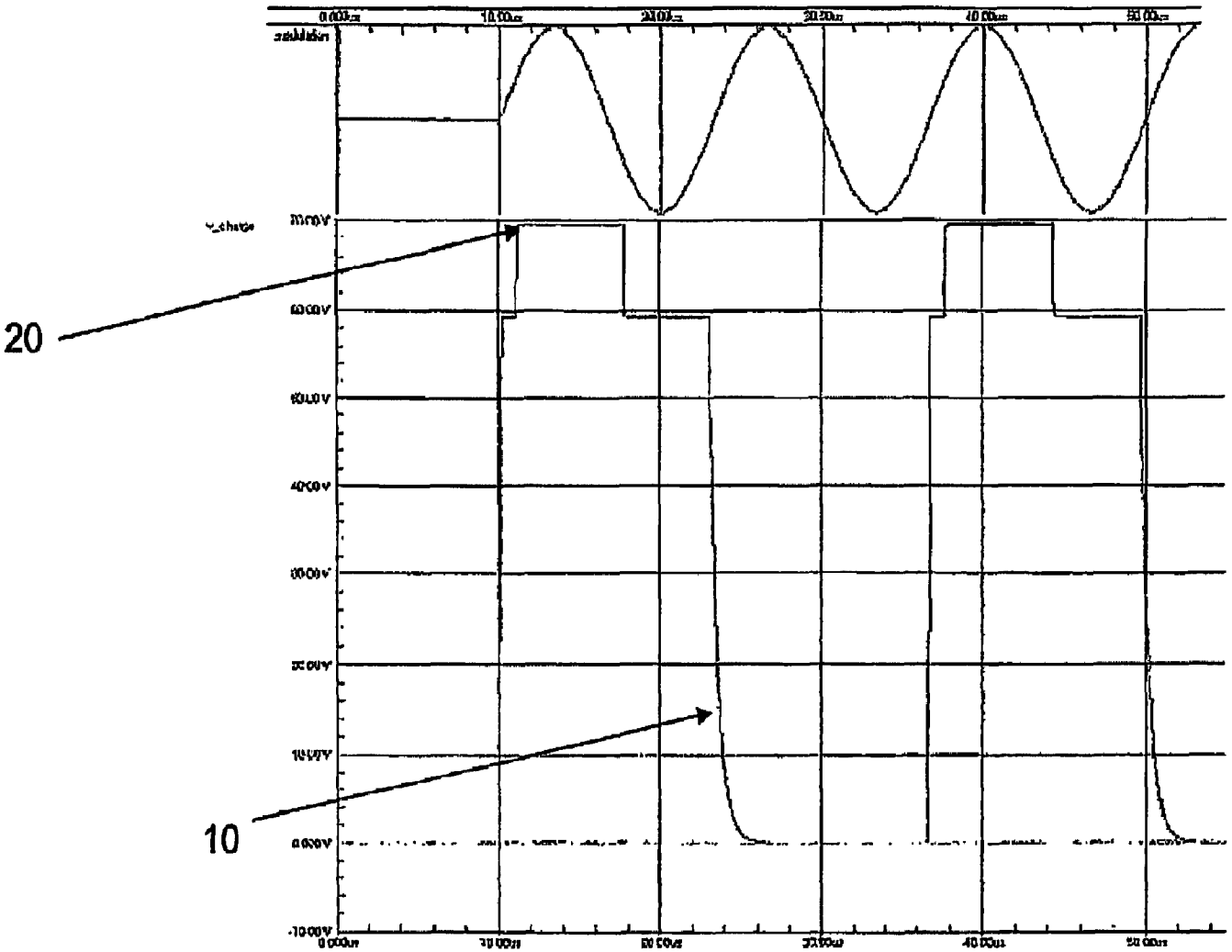
FIG. 1 shows a graphical depiction of a voltage that is used to control the phasing of the apparatus.

A known continuous ink jet printer apparatus is described in U.S. Pat. No. 6,309,058. This apparatus performs the phase setting operation in between printing operations, as described above. FIG. 1 shows a graphical depiction of a voltage that is used to control the phasing of the apparatus. In conventional apparatus, such as that described in U.S. Pat. No. 6,309,058, a substantially constant voltage is applied to the electrode drivers. As is shown in FIG. 1, a square wave pulse 20 is superimposed onto the charging voltage pulse 10: as the presence of the charge prevents the ink from being deposited on the substrate the addition of the square wave will not affect the print quality. As long as the square wave pulse is of significant magnitude, it is possible to detect the presence of the square wave pulse such that a phase detector can detect the difference in voltage from the background noise for at least one ink stream or a group of ink streams. It will be understood that the pulse could have a negative sense, that is that the square wave pulse be subtracted from the conventional charging voltage pulse 10. The pulse is preferably a half width pulse.

Figure 2:
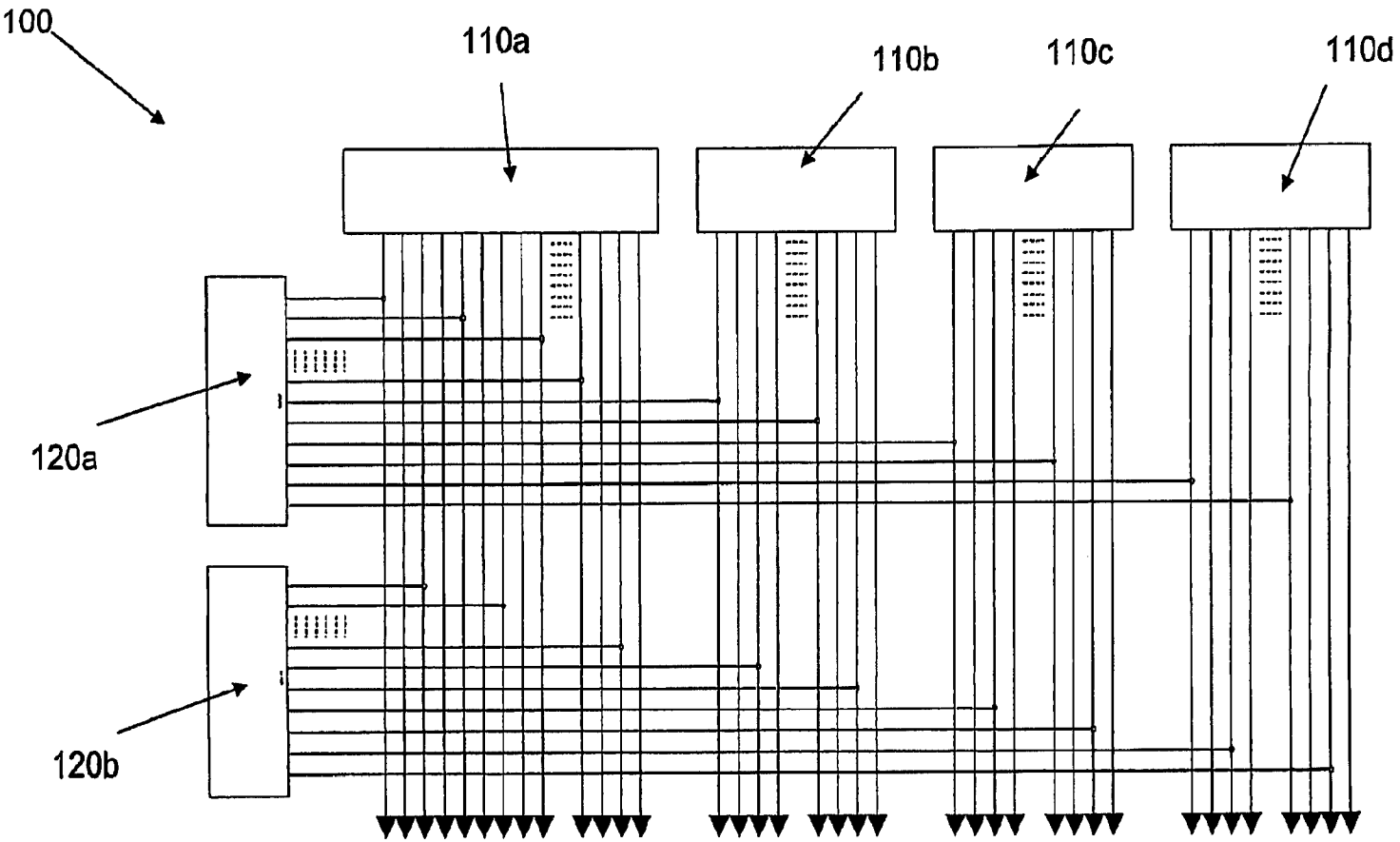
FIG. 2 shows a schematic depiction of a continuous phasing drive circuit according to the present invention.

FIG. 2 shows a schematic depiction of a continuous phasing drive circuit according to the present invention. The circuit 100 comprises a plurality of electrode drivers 110 and a plurality of phasing drivers 120; in the example shown in FIG. 2 there are four electrode drivers 110*a*-110*d* and two phasing drivers 120*a* & 120*b*. The devices comprising the drivers have 64 outputs and thus the electrode drivers drive 256 electrodes and the phasing drivers have 128 drivers. The phasing drivers provide the continuous phasing charge to every other electrode (shown schematically in FIG. 2).

Figure 3:
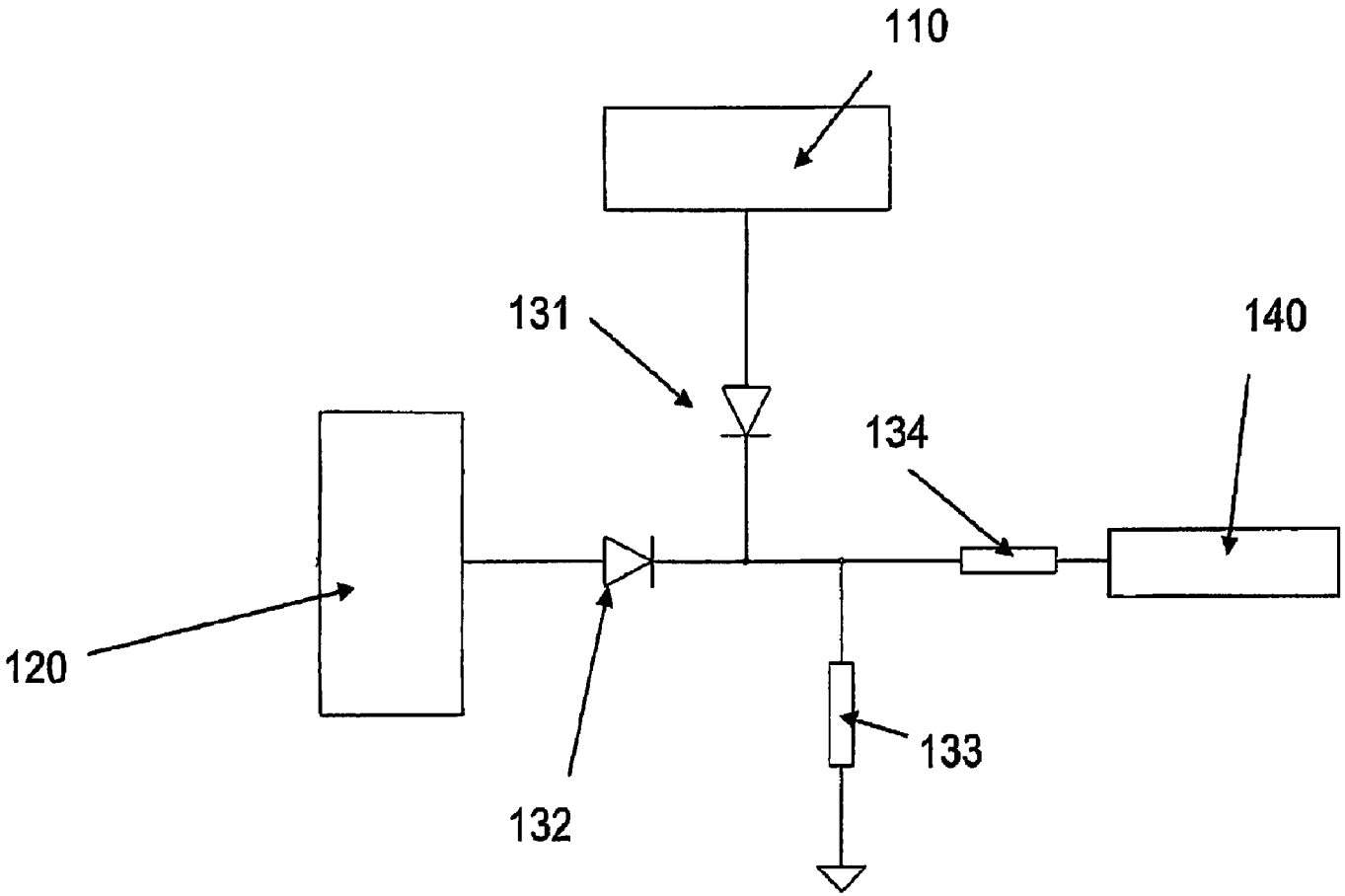
FIG. 3 shows a schematic depiction of the circuit used to drive a single charge electrode.

FIG. 3 shows a schematic depiction of the circuit 300 used to drive a single charge electrode. An output from the electrode driver 110 and the phasing driver 120 are connected to the charge electrode 140 via diodes 131, 132 and resistors 133 & 134. If the ink jet associated with the electrode 140 is to print onto the substrate then no signal is sent by either the electrode driver or the phasing driver. If the ink jet is not to print during the print cycle, or if the printer is in between print cycles then the electrode driver 110 will supply the normal voltage that causes the ink jet to be deflected. If the ink jet is to be phased then the phasing driver 120 will supply a square wave pulse to enable the phasing to be performed. The outputs from the electrode driver and the phasing driver are combined with the use of diodes. When either or both of the driver outputs switch on, the respective diode will turn on. When either or both driver outputs are off, the diodes are reverse biased and present high impedance to the electrode. Both the electrode driver and the phasing driver receive data from a print controller to instruct the drivers when print cycles are active and when phasing is to be performed, etc. in order that the application of control signals might be controlled suitably.

The value of resistor 133 is small enough to provide a discharge path for the charge electrode but large enough to minimise power dissipation. Resistor 133 preferably has a resistance of substantially 1 kΩ and provides for near end transmission line termination and the relatively high value also provides current limiting to prevent damage during ink spills on the charge electrode assembly.

Figure 4:
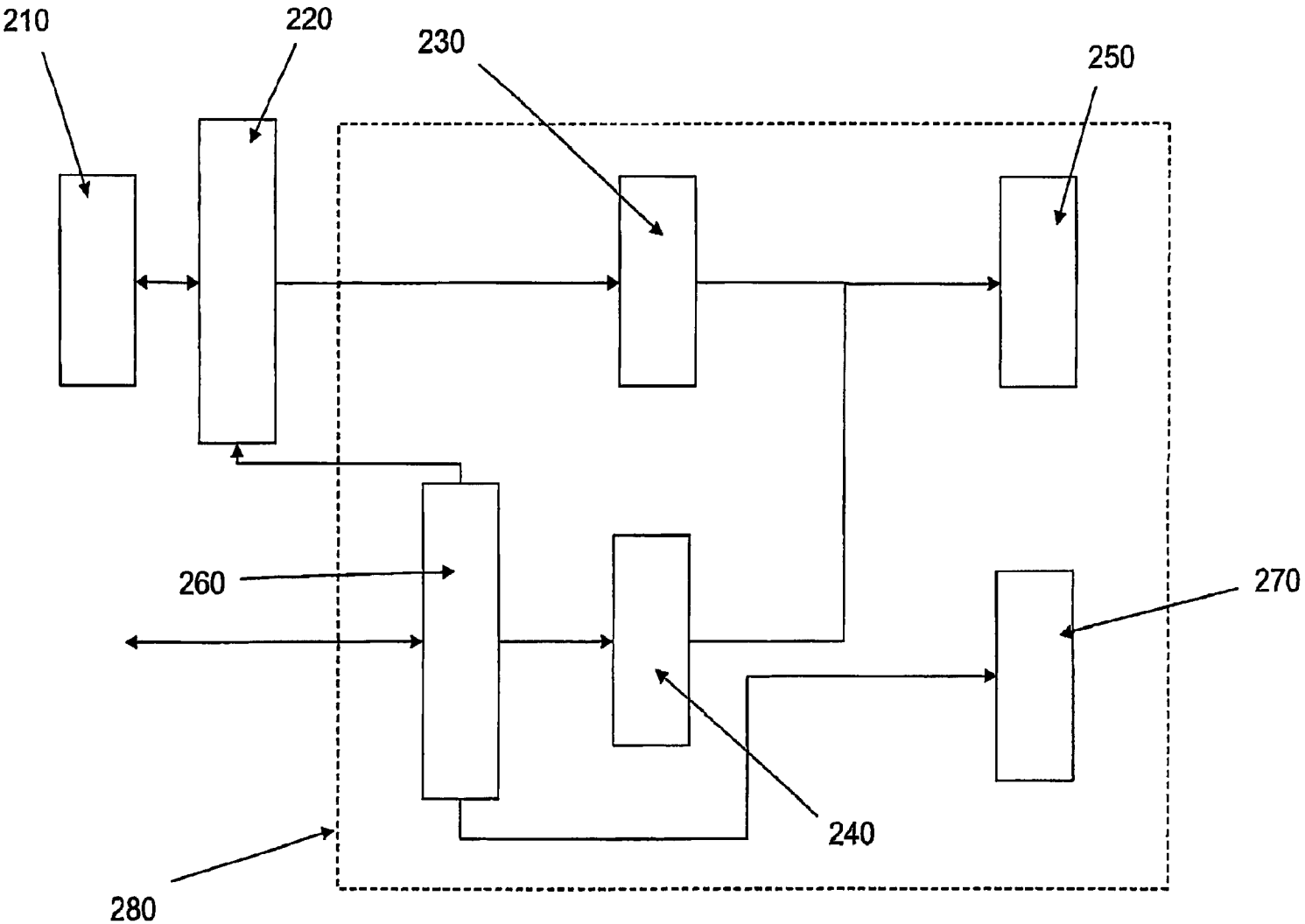
FIG. 4 shows a schematic depiction of a controller for the phasing drivers and the electrode drivers.

FIG. 4 shows a schematic depiction of a controller for the phasing drivers and the electrode drivers. Serial interface 210 receives data from and transmits data to a print manager (not shown). The received serial data is converted into parallel (and data for onward transmission to the print manager is converted from parallel to serial) by the data converter 220. Image processing means 230 processes the parallel data and groups it into frames at the modulation frequency (each frame may contain commands and/or image data) before buffering the image data. Control means 260 receives control and status information from other printer components, including phase data. The phase data is transmitted to phase data buffer 240 and phase drivers controller 270. Phase data from phase data buffer 240 and image data from image processing means 230 are combined and sent to electrode drivers controller 250. Since the data flow to electrode drivers controller operates continuously, when no image data is available, for example between print cycles, the print manager sends all zeroes in the print data field of the frames sent to the serial interface.

Conventional systems that use off-line phasing, i.e. during the non-printing phase, send a half width charge pulse to a single droplet and vary the phase of the modulation signal. This method cannot be used while printing or during the inter-label period, because the phase of the modulation signal must remain constant during printing. The continuous phasing technique of the present invention sends half width charge pulses to the continuous phasing drivers, with the phase of these pulses under software control. When the printer manager has determined the continuous phasing data for all the ink streams and which of the phase patterns require updating, the phase data buffer is refreshed appropriately during a subsequent inter-label period.

Figure 5:
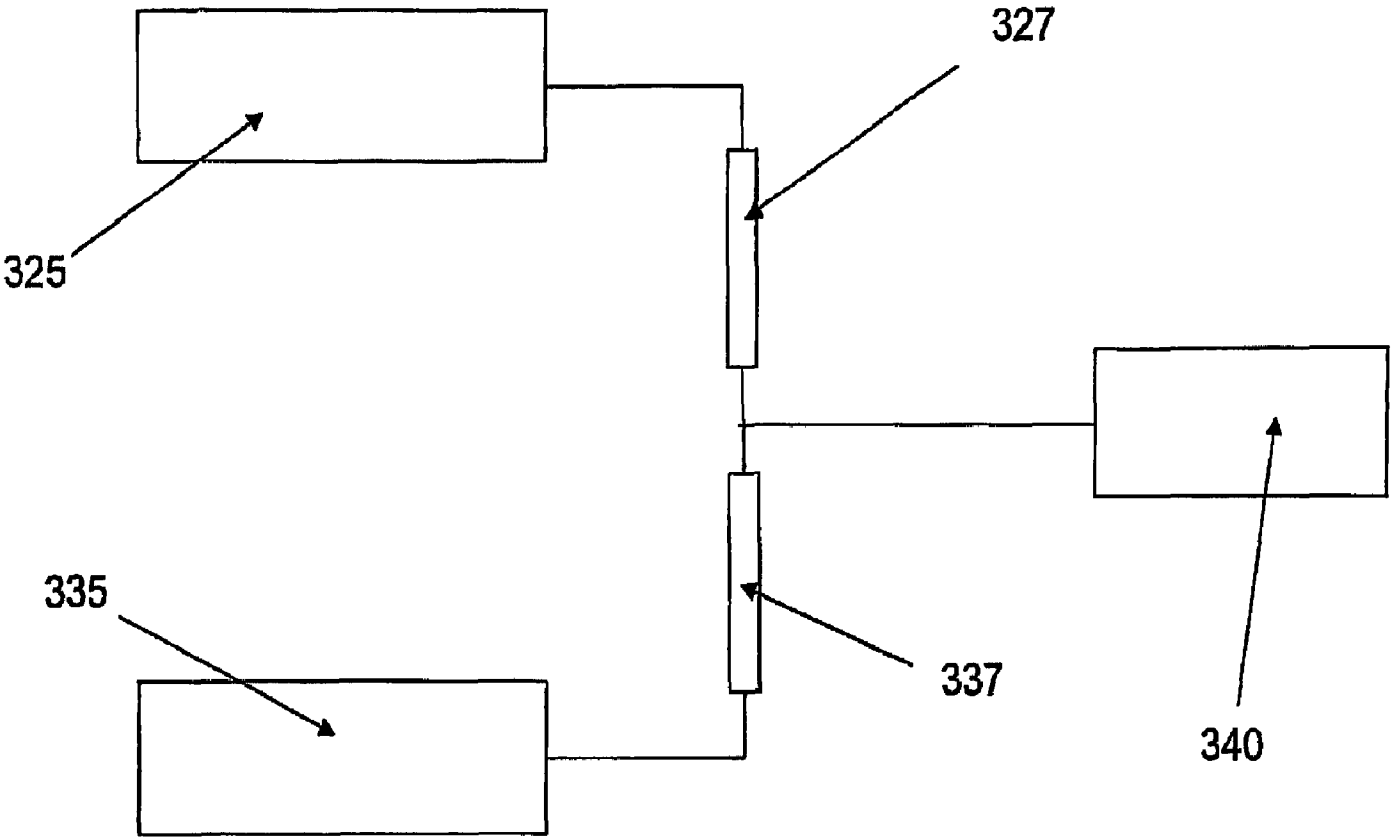
FIG. 5 shows a schematic depiction of a continuous phasing drive circuit according to a further embodiment of the present invention.

FIG. 5 shows a schematic depiction of a continuous phasing drive circuit according to a further embodiment of the present invention. First voltage driver 325 and second voltage driver 335 are connected to a charge electrode 340 via first resistor 327 and second resistor 337 respectively. To cause the ink jet connected to the charge electrode 340 to print onto the substrate both the first voltage driver and the second voltage driver send a low voltage signal to the charge electrode. In order to deflect the ink steam into the gutter both the first voltage driver and the second voltage driver send a high voltage signal to charge the ink stream.

In order to charge the charge electrode such that the phase of the ink jet may be detected, one of the drivers applies a high voltage signal and the other driver sends a low voltage signal. Through appropriate choices of the voltages applied by each of the voltage drivers and the resistance values of the first resistor and the second resistor, the voltage applied to the electrode can be set to a predetermined value. For example, both the first voltage driver and the second voltage driver may apply substantially equal voltage signals, the first resistor 327 has a value of 1 kΩ and second resistor 337 has a value of 4 kΩ. In this case, the voltage during 'phase detect' is 80% of the voltage applied by the drivers. It will be understood that these values are merely exemplary and that other combinations of driver voltages and/or resistor values may be used to provide a suitable voltage that can be used during the 'phase detect' process (i.e. a voltage that can reliably be detected as being different to the voltage used to deflect ink streams into the gutter). It will also be understood that more than two voltage drivers may be used in conjunction with a more complex resistor arrangement in order to provide suitable voltages for the three operational states.

This embodiment of the present invention has a number of advantages: the apparatus only requires a few components in addition to the voltage drivers (and these are simple resistors); the resistors will only dissipate power during the phasing operation (which is infrequent compared with the printing operation) and there is no resistor dissipation during printing; the charge electrode can be supplied from a low source of impedance so that there is no requirement for a 'discharging' resistor and the rise and fall time of the signal at the charge electrode is relatively fast.

The present invention relates to a method and apparatus for providing continuous phasing and it will be understood that in all other respects known continuous ink jet printer apparatus may be used to implement the invention. It has been found that Supertex HV3418 drivers are suitable for use as phasing drivers and/or electrode drivers as they can provide 64 outputs, are able to drive those outputs at the voltages required for continuous phasing (up to 180V) and can provide the necessary square wave pulse to enable the detection of ink streams being phased. Furthermore, the HV3418 provides active push-pull high voltage outputs, ensuring fast rise and fall times of the charge electrode pulse. These are preferred to ensure that the electrostatic field at the charge electrode is quickly established to charge the drop and quickly collapsed to prevent the next drop being partially charged (if it is a printing drop). It will be understood that other device may be used for the phasing drivers and/or electrode drivers as long as they provide similar functionality.

The invention claimed is:

1. A method of operating a continuous ink jet printer apparatus, the method comprising the steps of: applying a first voltage pulse to an electrode in order to modify the direction of an ink stream; applying a second voltage pulse to the electrode for a pre-determined period of time in order to detect the phase of the ink stream; measuring the charge carried on the ink stream; and modifying the operation of the printer in response to the charge measured.

2. A method according to claim 1 wherein the timing and/or magnitude of the first voltage pulse is modified in response to the charge measured.

3. A method according to claim 1 or claim 2 wherein the second voltage pulse is positive.

4. A method according to claim 1 or claim 2 wherein the second voltage pulse negative.

5. A method according to claim 1 or claim 2 wherein the second voltage pulse is a half width pulse.

6. A continuous ink jet printer apparatus including circuitry for applying a first voltage pulse to an electrode in order to modify the direction of an ink stream, and for applying simultaneously a second voltage pulse to the electrode for a pre-determined period of time for detecting the phase of the ink jet stream.

7. A printer apparatus according to claim 6 wherein said circuitry comprises an electrode driver, a phasing driver and a network comprising diodes and resistors, the drivers being electrically connected to the electrode via the network, the printer apparatus being operable: in a first state in which no signal is sent by either of the drivers and the ink jet stream is allowed to print onto a substrate; in a second state in which the electrode driver applies the first voltage pulse to deflect the ink jet stream into a gutter; and in a third state in which the electrode driver applies the first voltage pulse and the phasing driver applies the second voltage pulse for detecting the phase of the ink jet stream.

8. A printer apparatus comprising an electrode, first and second voltage sources and a resistor network, the electrode being electrically connected to the voltage sources via the resistor network, the printer apparatus being operable: in a first state by applying a low signal from the first and second voltage sources to the electrode; in a second state by applying a low signal from the first voltage source and a high signal from the second voltage source to the electrode; and in a third state by applying a high signal from the first and second voltage sources to the electrode.

9. A printer apparatus according to claim 8 wherein: in the first state an ink jet stream associated with the electrode is allowed to print onto a substrate; in the second state the electrode is charged such that the phase of the ink jet stream can be detected; and in the third state the ink jet stream is deflected into a gutter.

* * * * *